United States Patent [19]

Slattery

[11] Patent Number: 4,528,921

[45] Date of Patent: Jul. 16, 1985

[54] KNIFE BLOCKS

[75] Inventor: Ian Slattery, Hixson, Tenn.

[73] Assignee: Spencer Wright Industries, Inc., Chattanooga, Tenn.

[21] Appl. No.: 599,956

[22] Filed: Apr. 13, 1984

[51] Int. Cl.[3] ..... D05C 15/00

[52] U.S. Cl. ..... 112/79 R

[58] Field of Search ..... 112/79 R, 79 A

[56] References Cited

U.S. PATENT DOCUMENTS

| | | | |
|---|---|---|---|
| 4,313,388 | 2/1982 | Biggs et al. | 112/79 R |
| 4,445,446 | 5/1984 | Beasley | 112/79 R |
| 4,491,078 | 1/1985 | Ingram | 112/79 R |

*Primary Examiner*—Ronald Feldbaum

*Attorney, Agent, or Firm*—Alan Ruderman

[57] ABSTRACT

A knife mounting block for a tufting machine is formed with a pair of reference surfaces one of which forms the angle of inclination and the other forms the angle of canter that the knives make with the tufting machine hooks, the reference surfaces cooperating with corresponding surfaces of the tufting machine knife bar. One of the reference surfaces includes a slot which receives a pin extending from the knife bar so as to determine the gauge between respective knife blocks. Positioning of the knife blocks on the bar will engage the pin within the slots and accurately gauge the blocks and thus the knives at the proper gauge. The knife bar may include a slidable member from which the gauging pins extend so that the pins can be adjusted to match the gauge of the hooks and compensate for accumulative gauging tolerances of the needle bar of the tufting machine. The knife blocks can thus be removed from the tufting machine and returned to the exact position when required.

15 Claims, 3 Drawing Figures

KNIFE BLOCKS

BACKGROUND OF THE INVENTION

This invention relates to tufting machines and more particularly to apparatus for adjusting and setting the gauge of the knife blocks of a cut pile tufting machine.

In the art of tufting cut pile or cut/loop fabric it is known to cooperatively engage a knife against a respective hook to sever all or selective loops on the hook. Conventionally, the knives are mounted in knife blocks which in turn are mounted in a knife bar. The conventional knife blocks have two or more elongated channels within which the knives are mounted and until recently such knife blocks had been mounted exclusively in a knife bar by means of a cylindrical spigot extending from the body of the block and which was inserted into a hole in a knife bar such as illustrated in U.S. Pat. No. 3,084,645. The angle of the block and thus the angle of the knives acting against the respective hooks was set by pivoting the block about the axis of the spigot and the block was secured by a screw or the like. As is known in the art the angle that the knife makes with the hook is a compound angle and is important for proper cutting of the arm on the hook as the knife and hook act in scissors-like fashion. The compound angle comprises an angle of inclination, i.e., the angle the block is pivoted about the axis of the spigot, and the angle of canter, this latter angle being provided by boring the spigot receiving hole in the bar at a slight angle.

Because of numerous cutting problems resulting from misalignment of the angle of inclination resulting from the inadvertant or incorrect setting of the knife blocks, especially when one considers the minimal space within which a mechanic must work, numerous attempts have been made to ensure that this angle is correctly set. One such proposal is illustrated in Lund U.S. Pat. No. 4,175,497 assigned to the common assignee as the present invention, in which pins on the knife bar engage slots on the knife blocks to position the blocks about the spigots. Moreover, especially in relation to fine gauge tufting machines, use has been made of knife modules within which the knives are fixably embedded by molding the knives into a body member having alignment surfaces which fix the compound angle of the knives. In that case the knives are aligned in a jig during formation of the module and each body member has alignment surfaces for clamping the module to the knife bar. However, a disadvantage of the modular construction is that when only a single knife is worn or broken, an entire module must be replaced. Although such a disadvantage may be insignificant for very fine gauge modules, it may be significant for other tufting machines.

Consequently, other proposals have been made, one such proposal being illustrated in Ingram U.S. patent application No. 524,150 filed Aug. 18, 1983 and assigned to Spencer Wright Industries, Inc. the assignee of the present invention. In that application knife mounting apparatus is disclosed including a knife mounting block for carrying a plurality of replacable knives in channels formed therein, and the block having reference surfaces for providing the correct angle of inclination and the correct angle of canter to the knives when mounted in the tufting machine. The reference surfaces cooperate with corresponding surfaces of the knife bar and simple clamping means secures the blocks to the knife bar. However, since these proposed knife blocks use no spigots the gauge between knives in adjacent blocks is not positively fixed. For example, in most tufting machines the gauge between adjacent needles in the needle bar sets what is known as "the gauging" that is, the gauge of the needle bar acts as a datum for the other gauge parts. Thus, after the needles are mounted in the tufting machine the hooks are inserted so as to cooperate with or suit the needles, and there may be spaces or gaps between secions of, for example, hook modules. Thereafter, the knife blocks are inserted to suit the hooks.

In practice, even though manufacturing tolerances may be very low, the length of a needle bar is approximately 160 inches which can result in a relatively substantial accumulated tolerance such as to result in off-gauge problems. When this occurs the hooks can be suited to the needles by setting short lengths of hook bars to the needles individually. Since knife blocks having no spigots do not have a spigot hole in the knife bar, there is no reference by which the gauge of the hooks can be matched for compensating for the accumulative tolerance of the needle bar. Thus, even though the individual knives may be matched or suited to the hooks and the needles, if a knife block is removed from the tufting machine there is no assurance that when reinserted therein the knives will be repositioned in matching disposition with the hooks. Rather than the gauge of the knives being constant, the knife blocks will abut adjacent blocks and the tolerance of the knife blocks will accumulate. Thus, some means of gauging knife blocks that have no spigots should be provided to permit repeatable positioning of all the knife blocks while able to compensate for manufacturing inaccuracies in the other components.

SUMMARY OF THE INVENTION

Consequently, it is a primary object of the present invention to provide in a block for mounting a plurality of knives on a cooperating knife bar having cooperating surfaces for providing the correct compound angle to the knives without using a spigot, means for gauging the knife block so that setting a knife in one block to a hook will properly gauge the knives of the other blocks.

It is another object of the present invention to provide a mounting construction for a knife block and knife bar for a tufting machine which permits a repeatable positioning of the knife block while compensating for errors in the other gauge parts.

It is a further object of the present invention to provide a knife mounting block for a tufting machine for receiving a plurality of knives in knife receiving channels, the block being formed with reference surfaces such that when mounted in the tufting machine the knives are disposed at a desired fixed compound angle relative to the hooks, the knife blocks and knife bars having cooperating gauging members, the members on the bar providing a gauging reference for accurately spacing the knives in various blocks apart an amount equal to the gauge.

Accordingly, the present invention provides a knife mounting block having at least a pair of knife receiving channels on opposite sides of a substantially central web, the body of the knife blocks being formed with a pair of reference surfaces, the surfaces forming the angle of inclination and the angle of canter that the knives must make with the hooks, such reference surfaces cooperating with the surfaces of the knife bar, and gauging means in the form of pins and slots, the slots being formed in a reference surface of the knife block and the other pins extending from the knife bar. Preferably the pins are spaced apart an amount substantially equal to the gauge of the machine multiplied by the number of knife channels per block such that positioning of the knife blocks on the bar will engage the pins within the slots and accurately dispose the blocks at the proper gauge. Preferably, the bar includes a slide member from which the gauging pins extend so that the reference can be adjusted to match the gauges of the hooks to compensate for the accumulative gauging tolerance of the needle bar across its length. With this construction the knife blocks can be removed from the machine and returned to the exact position when necessary. Moreover, the construction permits repeatable positioning of all the knife blocks while permitting compensation for errors in the other components.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 1:
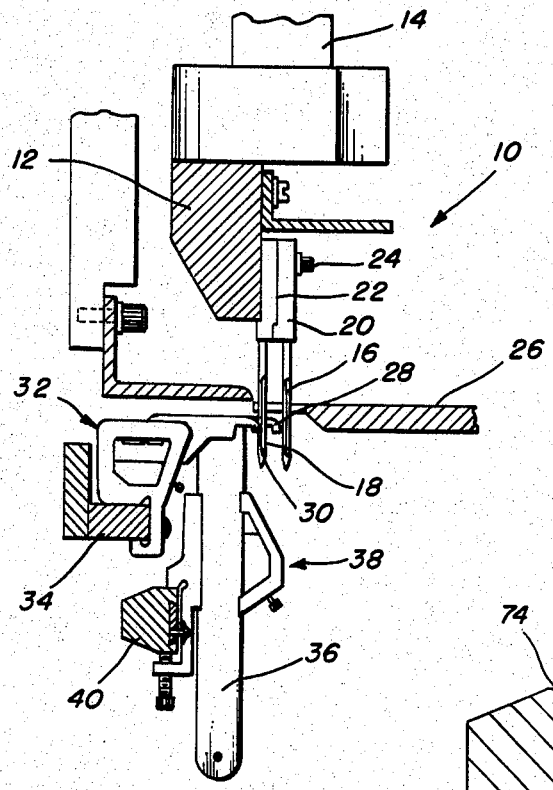
FIG. 1 is a vertical cross-sectional view taken transversely through a cut pile tufting machine incorporating knife blocks and knife bars constructed in accordance with the principles of the present invention.
Figure 2:
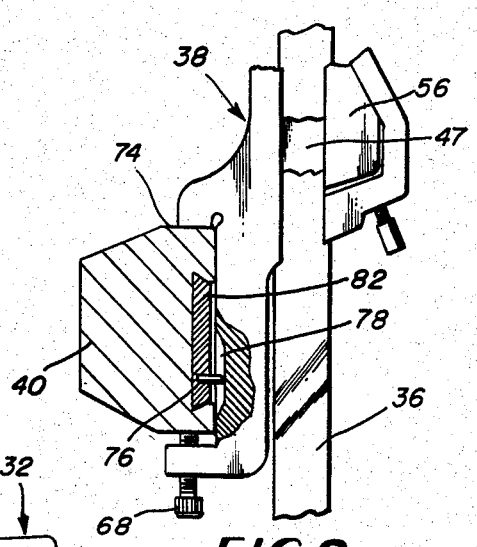
FIG. 2 is a fragmentary vertical cross-sectional view of a portion of the machine illustrated in FIG. 1 greatly enlarged.
Figure 3:
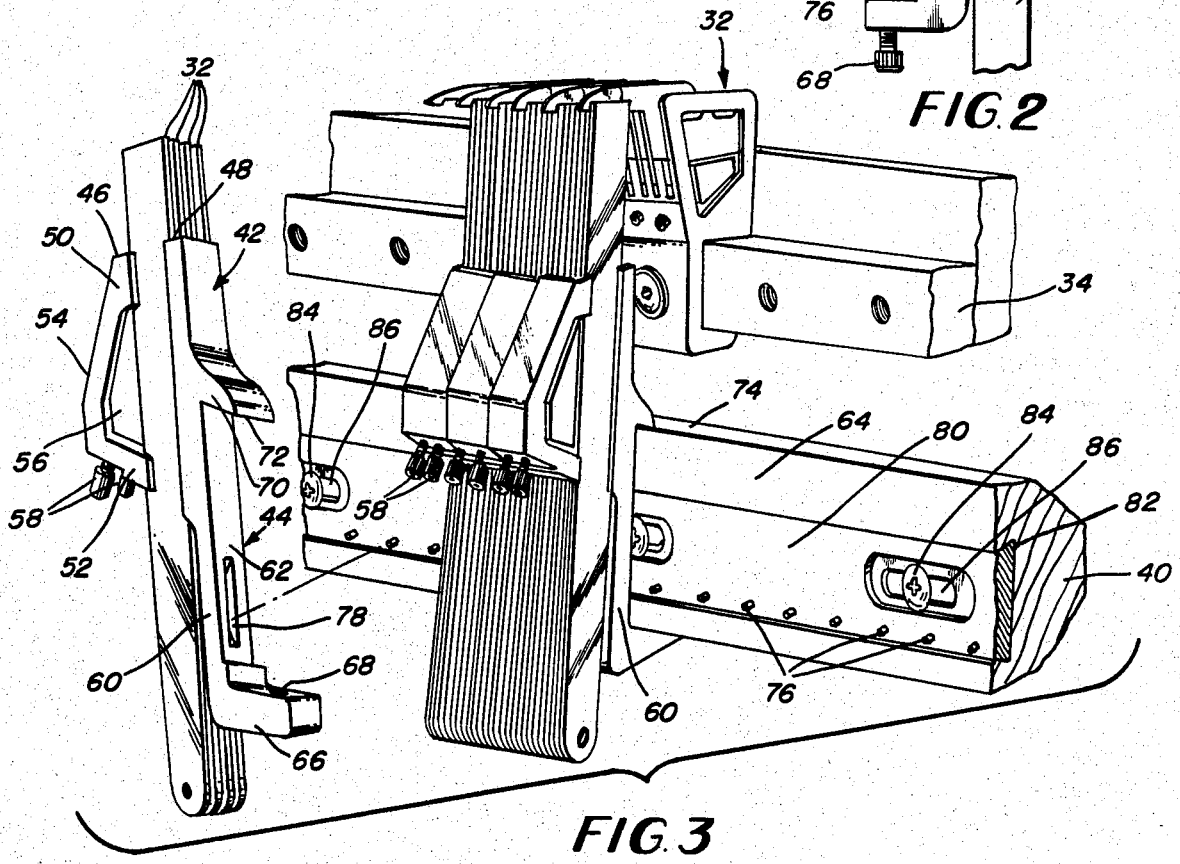
FIG. 3 is a perspective view of the knife bar and knife blocks illustrated in FIG. 1 with one of the blocks disassembled from the bar and rotated to illustrate the bar cooperating reference surface.

Referring now to the drawings and particularly to FIG. 1, the relevant portions of a tufting machine 10 are illustrated as including a needle bar 12 supported in the machine head at the end of one or more push rods 14 reciprocably driven axially in conventional manner. Carried by the needle bar 12 and preferably arranged in rows disposed one behind the other and off-set or staggered in the longitudinal direction of the needle bar is a plurality of needles 16,18, (only one in each row being illustrated). The needles 16, 18 may be mounted in holes drilled in the needle bar at locations spaced apart by an amount equal to the gauge of the machine, or the needles may be arranged in modular units as illustrated, the needles 16 being carried in a first body member 20 and the needles 18 carried in a second body member 22, the two body members having cooperating locating surfaces and being secured to the needle bar 12 by a common screw 24.

Mounted in the bed of the tufting machine beneath the machine head below the needle plate 26 is a plurality of front hooks 28 and a plurality of rear hooks 30, the hooks 28 cooperating with the needles 16, and the hooks 30 cooperating with the needles 18 to seize the loops of yarn presented by the respective needles. The hooks are mounted in a hook mounting block generally indicated at 32 as fully described in the aforesaid U.S. application of Ingram and the mounting block 32 is secured to a hook bar oscillated in conventional manner so that the hooks cooperate with the needles as aforesaid. The hooks 28, 30 also cooperate with respective knives 36 mounted in knife blocks 38 as hereinafter described, the knives and hook throats being illustrated as aligned for ease of presentation. The knife blocks 38 are secured to a knife bar 40 oscillated in timed relationship with the oscillation of the hooks for coacting with a face of the respective hooks in scissors-like manner for cutting the loops of yarn on the hooks to form cut pile.

As fully disclosed in the aforesaid patent application of Ingram the knife blocks 38 may comprise a body member having knife mounting means in the upper portion 42 and extending to a lower portion 44 for attaching to the knife bar 40. The upper portion 42 comprises a pair of flanges 46 and 48 connected together by a central web 47 extending substantially normally between the flanges. Conventionally, the knives 36 are received within the knife receiving channels formed by undercutting grooves into the flanges 46, 48 at opposite sides of the central web and at spaced locations therefrom, the number of grooves in each flange being equal and dependent upon the number of knives carried by the knife block which as illustrated is preferably four. The space between adjacent grooves is equal to the gauge of the parts, e.g., the knives.

The flange 46 and the grooves formed therein are in two sections, an upper section 50 and a lower section 52. The upper and lower sections are spaced apart in the direction in which the knives extend, but are connected together by a bridge member 54 which flares outwardly from the knife channels from each section 50, 52 to define a space or hollow which extends through the entire knife block and receives at least one and preferably two clamping inserts 56 having a shape corresponding to that of the hollow. A pair of tapped holes are formed in the lower section 52 for receiving a corresponding screw 58 each of which extends through the wall of the section 52 and enters a respective seat in the insert 56 to hold it within the hollow. By tightening the screws 58 the respective inserts are forced into contact with the edge of corresponding knives 36 to secure the knives in the knife block channels, each insert acting against a pair of adjacent knives.

The lower portion 44 of the knife block 38 comprises an extension of the flange 48 beyond the longitudinal terminus of the knife grooves to form an elongated knife bar spanning member 60. The surface of the spanning member 60 facing the knife bar that is in the surface 62, is machined at a slight angle relative to the plane of the knife channels and the surface 64 of the knife bar 40 against which it is disposed to provide the proper angle of canter for the knives. This angle is normally in the range of approximately 4 degrees.

Extending from the lower edge of the spanning member 60 is a ledge 66 having a tapped bore 68 into which a screw 68 is threaded. Spaced above the ledge 66 and extending from the rear of the flange 48 is another ledge 70 having a surface 72 facing the ledge 66. The surface 72 projects outwardly from the surface 62 and is inclined relative thereto and relative to the plane of the web and thus the knife channels in the direction transverse to the knife block so that when the knife block is positioned on the upper surface 74 of the knife bar 40 the blocks and thus the knives 36 are inclined relative to the knife bar and cooperating hooks 28, 30, the angle of inclination as normally being in the range of approximately 8 degrees.

Thus, the surfaces 62 and 72 provide reference surfaces which cooperate with respective reference surfaces 64 and 74 of the knife bar 40 to provide the desired compound angle for effective cutting action between the knives and the cooperating hooks. It should be understood that both the angle of canter and the angle of inclination results in the desired compound angle of the web and thus the knife channels and knives relative to the knife bar 40, the hook bar 32 and thus the plane of the hooks 28, 30. As aforesaid, in the prior art this angle was obtained by a spigot or shaft on the knife block disposed in a bore within the knife bar, the bore being cantered relative to the bar and the block being rotated about the spigot, or the knives were molded within a knife module at the proper angle in a jig and thus were not replaceable.

Because the surfaces 62, 72 provide reference surfaces to set the compound angle that the knives act against the hooks, the spigots of the prior art and the spigot receiving bores in the knife bar, and their associated problems, are avoided. However, this construction therefore has no reference by which the gauge of the knives can be suited to gauge of the hooks with desirable repeatability. To solve this problem the present invention provides a means for gauging such knife blocks to ensure that the knives are properly gauged to the hooks which themselves are gauged to the needles.

To this end, the knife bar includes a plurality of gauging pins 76 spaced apart the exact amount of the desired gauge. Formed in the reference face 62 of the knife blocks is a slot 78 which is adapted to receive a respective one of the pins 76. Consequently, the knife blocks 38 may be mounted on the knife bar 40 at the correct gauge with each block "gauged" by a pin 76 and the respective slot 78. To provide adjustability the pins 76 are mounted on a gauging plate 80 slidably disposesd within a channel 82 formed in the knife bar 64. The channel 82 and the plate 80 preferably have conforming dovetail configurations and the lateral position of the plate is determined by a number of screws 84 extending through elongated slots 86 formed in the plate 80 and threadedly received within the bar 64.

With the aforesaid construction knife blocks may be removed from the machine and returned to exact repeatable positions. For each section of knife blocks setting the knife of one block will set the gauge of the others. It permits repeatable positioning of all the knife blocks while compensating for errors in the other gauge parts components. For example, since the pins 76 are preferably mounted on a moveable plate the gauging reference can be adjusted to match the gauges of the hooks to compensate for the accumulatived tolerances of the needle bar from end to end.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. In a tufting machine having a knife bar, a plurality of knife mounting blocks for mounting a plurality of tufting machine knives, each knife comprising a substantially rectangular planar member having a pair of opposed edges, each of said blocks comprising an elongated body member having a pair of spaced flanges, a plurality of knife receiving channels spaced apart in side-by-side relationship along said body member, each channel being defined by a pair of facing grooves formed in said flanges for receiving the opposed edges of a knife, a pair of elongated mounting reference surfaces on said body member adapted for mating with corresponding mounting surfaces of said knife bar, each of said reference surfaces being disposed angularly relatively to the plane of said channels, said knife bar including a plurality of spaced pins extending from one of said knife bar mounting surfaces, the spacing between adjacent pins being equal to the spacing between adjacent channels multiplied by the number of channels in each block, and a pin receiving opening formed in the corresponding reference surface of said block for receiving a respective one of said pins for setting the gauge of said blocks.

2. In a tufting machine as recited in claim 1, including a plurality of hooks, each knife cooperating with a respective hook for cutting loops thereon, and wherein the reference surface of the block in which said pin receiving opening is formed determines the camber of the knives relatively to the hooks.

3. In a tufting machine as recited in claim 1, wherein said knife bar includes means for adjustably positioning said pins relatively to said bar.

4. In a tufting machine as recited in claim 1, wherein said knife bar includes a slideway formed therein, a slide member positioned in said slideway and slidable relatively to said bar, said pins extending from said slide member, and means for fastening said slide member to said bar at selected locations.

5. In a tufting machine as recited in claim 1, including a plurality of hooks, each knife cooperating with a respective hook for cutting loops thereon, and wherein one of said surfaces defines the inclination of the knife relative to said hook and the other surface defines the camber of said hook.

6. In a tufting machine as recited in claim 5, wherein the reference surface of the block in which said pin receiving opening is formed comprises said other surface.

7. In a tufting machine as recited in claim 6, wherein said knife bar includes means for adjustably positioning said pins relatively to said bar.

8. In a tufting machine as recited in claim 6, wherein said knife bar includes a slideway formed therein, a slide member positioned in said slideway and slidable relatively to said bar, said pins extending from said slide member, and means for fastening said slide member to said bar at selected locations.

9. In a tufting machine having a knife bar, a plurality of knife mounting blocks for mounting a plurality of tufting machine knives, each knife comprising a substantially rectangular planar member having a pair of opposed edges, each of said blocks comprising an elongated body member having a pair of spaced flanges, a plurality of knife receiving channels spaced apart in side-by-side relationship along said body member, each channel being defined by a pair of facing grooves formed in said flanges for receiving the opposed edges of a knife, a pair of elongated mounting reference surfaces on said body member adapted for mating with corresponding mounting surfaces of said knife bar, each of said reference surfaces being disposed angularly relatively to the plane of said channels, one of said knife bar and said block including a plurality of spaced pins extending from a respective one of said knife bar mounting surfaces and corresponding reference surface of said block, the spacing between adjacent pins being equal to the spacing between adjacent channels multiplied by the number of channels in each block, and a pin receiving opening formed in the other of said knife bar mounting surface and corresponding reference surface of said block for receiving a respective one of said pins for setting the gauge of said blocks.

10. In a tufting machine as recited in claim 9, wherein said slots are formed in one of said knife bar mounting surfaces, and said pins extend from the corresponding reference surface of said block.

11. In a tufting machine as recited in claim 10, including a plurality of hooks, each knife cooperating with a respective hook for cutting loops thereon, and wherein the reference surface of the block from which said pin extends determines the camber of the knives relatively to the hooks.

12. In a tufting machine as recited in claim 10, wherein said knife bar includes means for adjustably positioning said pins relatively to said bar.

13. In a tufting machine as recited in claim 11, including a plurality of hooks, each knife cooperating with a respective hook for cutting loops thereon, and wherein one of said surfaces defines the inclination of the knife relative to said hook and the other surface defines the camber of said hook.

14. In a tufting machine as recited in claim 13, wherein the reference surface of the block from which said pin extends comprises said other surface.

15. In a tufting machine as recited in claim 14, wherein said knife bar includes means for adjustably positioning said slots relatively to said bar.

* * * * *